US011257651B2

(12) United States Patent
Takman et al.

(10) Patent No.: US 11,257,651 B2
(45) Date of Patent: Feb. 22, 2022

(54) DETERMINING WIDTH AND HEIGHT OF ELECTRON SPOT

(71) Applicant: Excillum AB, Kista (SE)

(72) Inventors: Per Takman, Kista (SE); Ulf Lundström, Kista (SE); Björn Hansson, Kista (SE)

(73) Assignee: EXCILLUM AB, Kista (SE)

( * ) Notice: Subject to any disclaimer, the term of this patent is extended or adjusted under 35 U.S.C. 154(b) by 0 days.

(21) Appl. No.: 16/973,497

(22) PCT Filed: Jun. 24, 2019

(86) PCT No.: PCT/EP2019/066710
§ 371 (c)(1),
(2) Date: Dec. 9, 2020

(87) PCT Pub. No.: WO2020/002260
PCT Pub. Date: Jan. 2, 2020

(65) Prior Publication Data

US 2021/0249215 A1 Aug. 12, 2021

(30) Foreign Application Priority Data

Jun. 25, 2018 (EP) ..... 18179548

(51) Int. Cl.
*H01J 35/14* (2006.01)
*H01J 35/08* (2006.01)
(Continued)

(52) U.S. Cl.
CPC ..... *H01J 35/147* (2019.05); *H01J 35/112* (2019.05); *H01J 35/14* (2013.01);
(Continued)

(58) Field of Classification Search
CPC ..... H01J 35/147; H01J 35/14; H05G 1/26; H05G 1/52
See application file for complete search history.

(56) References Cited

U.S. PATENT DOCUMENTS 9,380,690 B2 6/2016 Hemberg et al.
2008/0075234 A1 3/2008 Seijbel et al.
(Continued)

FOREIGN PATENT DOCUMENTS

DE 102010009276 A1 8/2011
EP 3312868 A1 4/2018

OTHER PUBLICATIONS

International Search Report (PCT/ISA/210) dated Dec. 10, 2019, by the European Patent Office as the International Searching Authority for International Application No. PCT/EP2019/066710.
(Continued)

*Primary Examiner* — Chih-Cheng Kao
(74) *Attorney, Agent, or Firm* — Buchanan Ingersoll & Rooney P.C.

(57) ABSTRACT

A method in an X-ray source configured to emit, from an interaction region, X-ray radiation generated by an interaction between an electron beam and a target, the method including the steps of: providing the target; providing the electron beam; deflecting the electron beam along a first direction relative the target; detecting electrons indicative of the interaction between the electron beam and the target; determining a first extension of the electron beam on the target, along the first direction, based on the detected electrons and the deflection of the electron beam; detecting X-ray radiation generated by the interaction between the electron beam and the target; and determining a second extension of the electron beam on the target, along a second direction, based on the detected X-ray radiation.

11 Claims, 4 Drawing Sheets

(51) Int. Cl.
*H05G 1/52* (2006.01)
*H05G 1/26* (2006.01)

(52) U.S. Cl.
CPC ..... *H01J 2235/082* (2013.01); *H05G 1/26* (2013.01); *H05G 1/52* (2013.01)

(56) References Cited

U.S. PATENT DOCUMENTS

| | | | | |
|---|---|---|---|---|
| 2013/0301805 | A1* | 11/2013 | Hemberg | H01J 35/147 378/137 |
| 2014/0219424 | A1* | 8/2014 | Smith | H05G 1/52 378/137 |
| 2015/0380202 | A1 | 12/2015 | Ollinger et al. | |
| 2016/0336140 | A1 | 11/2016 | Nonoguchi et al. | |
| 2019/0311874 | A1* | 10/2019 | Tuohimaa | H05G 1/52 |
| 2020/0154553 | A1* | 5/2020 | Dokania | H01J 35/06 |

OTHER PUBLICATIONS

Notification of Transmittal of The International Preliminary Report on Patentability (PCT/IPEA/409) dated Sep. 2, 2020, from the International Preliminary Examining Authority for International Application No. PCT/EP2019/066710.

Written Opinion (PCT/ISA/237) dated Dec. 10, 2019, by the European Patent Office as the International Searching Authority for International Application No. PCT/EP2019/066710.

* cited by examiner

DETERMINING WIDTH AND HEIGHT OF ELECTRON SPOT

TECHNICAL FIELD

The invention disclosed herein generally relates to methods and devices for generating X-ray radiation. More precisely, the invention relates to characterisation and control of the interaction between an electron beam and a target in an electron-impact X-ray source.

BACKGROUND OF THE INVENTION

X-ray radiation may be generated by allowing an electron beam to impact an electron target. The performance of the X-ray source depends, inter alia, on the characteristics of the focal spot size of the X-ray radiation generated upon the interaction between the electron beam and the target. Generally, there is a strive for higher brilliance and smaller focal spot sizes of the X-ray radiation, which requires improved control of the electron beam and its interaction with the target. In particular, several attempts have been made to more accurately determine and control the spot size of the electron beam impinging on the target.

US2016/0336140 A1 is an example of such an attempt, in which a first and a second width of the cross section of the electron beam is measured by scanning the electron beam over a structured moving target while detecting backscattered electrons. The scanning is performed sideways relative the direction of motion of the target, and the electron beam is rotated 90° in order to acquire a measure of the cross section in both a height and a width direction.

This approach is however associated with several disadvantages. Firstly, the rotation requires an electron-optical modification of the beam that risks to distort the shape of the spot. This may reduce the reliability and accuracy of the measurements. Secondly, the rotation based technology may be difficult to implement in systems utilising an elongated, or line-shaped spot that is focused on a moving target. Rotating a line-shaped spot such that its length direction is oriented along the direction of motion may result in overheating of the target. Hence, there is still a need for improved devices and methods for generating X-ray radiation.

SUMMARY OF THE INVENTION

The present invention has been made with respect to the above limitations encountered in X-ray sources in general, and in the above referenced technology in particular. Thus, it is an object of the present invention to provide improved techniques for measuring the extension of the electron beam impinging on a target of the X-ray source.

Accordingly, methods and devices with the features set forth in the independent claims are provided. The dependent claims define advantageous embodiments of the invention.

Thus, a method in an X-ray source is proposed, wherein the X-ray source is configured to emit X-ray radiation upon interaction with an electron beam in an interaction region of the target. The width of the electron beam, or the focal spot formed by the electron beam on the target, may be determined in at least two directions, such as for example a vertical direction and a horizontal direction, by combining measurements of electrons that are indicative of the interaction between the electron beam and the target, with measurements of the X-ray radiation originating from the interaction region.

The width of the electron beam in the interaction region, where it impinges on the electron target, is an important factor affecting the X-ray generation process. It is not straightforward to determine the width in the interaction region by means of sensor areas located at a distance away from the interaction region. The present invention provides a method for carrying out a width measurement in a first direction by deflecting the electron beam over the target and detecting a response in terms of electrons indicating the interaction at the target. The detected electrons may for example be backscattered from the target, absorbed by the target and/or passing by the target (i.e., not interacting with the target). The target may for example comprise a structure that generates a contrast in the detected electron signal as the electron beam is scanned or deflected over the structure. The structure may for example be an interface between a first and a second material, a slit or groove, or other means that is capable of generating a contrast in for example electron absorption or backscattering. Thus, by moving the electron beam over such structure, the contrast in detected electrons may be used to determine or estimate a width of the electron beam in the scanning direction.

In some embodiments, the scanning may be performed between a first position, wherein the beam impinges on a sensor area unobscured by the electron target, a second position, where the electron target obscures the sensor area maximally, and a suitable set of intermediate positions. If the recorded sensor data are regarded as a function of the deflection settings, a transition between the unobscured position (large sensor signal expected) and the obscured position (small sensor signal expected) may be identified. The width of the transition corresponds to the width of the electron beam measured at the electron target. A width determined in this manner, in terms of deflector settings, may be converted into length units if a relationship between deflector settings and the displacement of the beam at the level of the interaction region is available.

In some embodiments the scanning may be performed between a first position, wherein at least half of the electron beam passes on a first side of the target before impinging on a sensor area unobscured by the electron target, and a second position, wherein at least half of the electron beam passes on a second side of the target before impinging on a sensor area unobscured by the electron target. A width of the electron beam may be extracted from the change in detected electrons as the beam is scanned from the first side of the target to the other. In this way also beam widths exceeding the target width may be measured.

It is advantageous to perform the scanning in a direction perpendicular to an edge or other contrast generating means of the electron target; however, oblique scanning directions may be compensated by data processing taking into account the scanning angle against the edge.

It may be possible to extract more detailed information about the electron beam, in particular its shape or intensity profile, by processing the electron sensor data by Abel transform techniques, which are known per se in the art.

The beam width may be derived from the information provided by sensors of the types disclosed in the above examples.

The present invention further provides for a method for carrying out a width measurement of the electron beam in a second direction by measuring an X-ray spot size. The X-ray spot size may be understood as a size or extension of the source from which the X-ray radiation emanates. The measurements may be carried out by means of a sensor area that is sensitive to the generated X-ray radiation. Examples of techniques for determining the X-ray spot size may for example utilize a pinhole, a slit or a rollbar for imaging. A full two-dimensional spatial distribution of the X-ray spot may be obtained by the pinhole method, wherein the images of the slit and the rollbar corresponds to a line-spread function and an edge-spread function, respectively. These exemplary methods may be used for deriving the width of the X-ray spot in the second direction, such as the spot height, by utilizing the relationship between the position of the interaction region and the sensor area, the detected signal and any X-ray optics arranged there between.

The size of the X-ray spot, or source spot, which may be quoted as an evaluation of the resolving power of the X-ray source depends, inter alia, on the size of the electron spot and the scattering of electrons and photons within the target. The impinging electron beam tends to penetrate the target material to a certain depth, which results in that a volume of the target material becomes activated and emits X-ray radiation. However, the X-ray radiation tends to be attenuated by the target material. The more target material the X-ray radiation has to pass before leaving the target, the more attenuated it gets. The actual size, or effective size, of the X-ray spot may thus be determined as the size of the X-ray radiating volume of the target material that generates detectable X-ray radiation, i.e., radiation that actually leaves the target. Hence, the size of the X-ray spot can be used to derive knowledge of the corresponding spot size of the electron beam causing the target material to emit the X-ray radiation. Advantageously, the conversion between X-ray spot size and electron spot size may be based on the target material's tendency to scatter the electrons, the target material's ability to absorb X-ray radiation, the penetration depth of the impinging electrons, angle of incidence of the electron beam, and geometry of the target.

The present inventive concept hence allows for the width of the electron spot to be determined in at least two directions, such as e.g. a lateral direction and a vertical direction, without carrying out a rotation of the electron spot. This is particularly advantageous for so called line shaped spots, having a width in a first dimension that is significantly larger than a width in another dimension, and especially when used on moving targets. In such systems, it is desirable to arrange the electron spot such that the largest width (the length extension of a line-shaped spot) is oriented across the target in the direction of the axis of rotation (in case of a rotating target), i.e., substantially perpendicular to the travelling direction of the target at the interaction region, and such that the smallest width (the thickness or height of a line-shaped spot) is in the travelling direction. Experiments have shown that a spot being as wide as possible across the travelling direction allows for a relative high total power of the electron beam to be used without overheating the target. In particular, by making the spot wider more total power can be applied without increasing the maximum power density, or power per unit length. Further, it is advantageous if the spot is as small or narrow as possible in the travelling direction, since this results in an X-ray source with high brightness.

Thus, it may be a delicate task to setup and calibrate the X-ray source such that the performance of the generated X-ray radiation is maximised without damaging the target. Put differently, it is desirable to operate the X-ray source, and the electron source in particular, as close as possible to the damage threshold without actually passing the threshold. Considering this, it may be a discouraging endeavour to rotate a calibrated and optimised spot in order to determine its size, and the skilled person might be tempted to reduce the total power of the electron beam during the measurements in order to protect the target from potential damage. By rotating a line shaped electron spot such that it is aligned in the travelling direction of the target material, the target material is exposed to the electron beam for an increased period of time and may therefore be overheated. The present inventive concept provides a solution to this challenge, as it allows for the electron spot to be measured both along the travelling direction of the target and in an orthogonal direction while maintaining the original orientation and total power of the electron beam.

As already mentioned, the measured or detected electrons used for determining the spot width in the first direction may be electrons that impinges on the sensor area instead of the target. Those electrons may in other words be generated by the electron source and have a trajectory that allows them to pass towards the sensor area.

Alternatively, or additionally, electrons emitted from the target may be studied as well. Such electrons are backscattered when the electron beam is radiated on the target, and comprise recoil electrons that are elastically scattered inside the target material and emitted therefrom. It is appreciated that the number of backscattered electrons can be indicative of the number or electrons impinging on the target, and thus vary as the electron beam is scanned over the target.

In another example, secondary electrons may be studied as well. Secondary electrons may be considered as electrons having lower energy than the electrons of the electron beam, and may be generated as ionisation products.

In a further example, the electrons absorbed by the target may be detected in order to indicate its interaction with the electron beam. The absorbed electrons may be detected by a detecting device, such as for example an ammeter connected to the target.

The electron beam may be controlled such that a power density (or current, intensity or thermal load) supplied to the target is maintained below a predetermined limit so as to avoid overheating of the target, heat induced damages and/or excessive debris production. There are several ways of measuring and defining the thermal load on the target. One option is to determine the power density as the ratio between the total power of the electron beam and the area of the electron spot on the target. Alternatively, the maximum power supplied to each point of the target may be considered instead. In case of a line-shaped spot oriented transverse to the travelling direction of a moving target, it may be beneficial to measure a power density distribution along the length direction of the spot.

Thus, by being able to determine a width of the electron spot in a first and a second direction, it may be possible to determine the power density, or power density distribution of the electrons interacting with the target. This, in turn, may allow for the electron source to be controlled accordingly such that the X-ray source can be operated closer to the damage threshold (at which target damage and excessive debris production may occur) and thus at a higher performance.

It is noted that, for the purpose of the present disclosure, the electron beam may be characterised by its ability to deliver a certain power to the target. The power, known to be defined as total amount of energy delivered to the target per unit time, may be determined by the energy, and total number (or flux), of electrons delivered per unit time. The delivered power per unit area (or unit length) of the target may be referred to as power density, and may be considered to represent an average power per unit area (or unit length) of the electron spot region of the target. In the context of the present disclosure, the terms "power density profile" and "power density distribution" may be used interchangeably to denote the local distribution of the power density within a certain region of the target. These terms are introduced to capture the fact that the power density may vary over a cross section of the electron beam, such that different portions of the electron spot on the target may be exposed to different thermal loads.

According to an embodiment, a quantity indicative of the power density of the electron beam may be determined by deflecting the electron beam along a first direction relative the target and detecting electrons indicative of the interaction between the electron beam and the target. The quantity may be the power density profile along the first direction. However, it may be sufficient to determine e.g. an extension of the electron beam along said first direction, or a maximum in the power density along said first direction. Furthermore, the electron beam may be adjusted to attain some desired effect while maintaining the power density below a predetermined limit. This may correspond to keeping said quantity indicative of a power density below a certain value. The exact correspondence between said quantity and the actual power density may not be required to achieve the intended objective, i.e. to adjust the electron beam to optimize the outgoing X-ray radiation without overloading the target.

According to an embodiment, the electron beam may be adjusted such that the second extension of the electron beam on the target is decreased, while the first extension of the electron beam on the target is maintained. In case of the electron spot on the target being substantially line-shaped, the present embodiment may be understood as a way of reducing the line thickness of the spot while maintaining its length.

In the following, the configuration of an example embodiment of the invention will be described. In this particular embodiment, the electron target may be a moving target, such as a rotating solid target or a liquid metal jet target, travelling in a direction that may be substantially perpendicular to the electron-optical axis of the X-ray source, along which the electron beam travels on its way to the interaction region. According to an embodiment, the X-ray radiation generated by such a setup may exit through an X-ray transparent window oriented along an axis that is substantially perpendicular to both the travelling direction and the electron-optical axis. Viewing the interaction region from the electron source's perspective, this direction may be referred to as "sideways" or laterally relative the target. The X-ray sensor may be arranged at different positions relative the interaction region. For reasons of space, it may however be desirable to arrange the X-ray sensor at the opposite side of the target as the X-ray window, along the axis passing through the X-ray window and the interaction region. At this position, the X-ray sensor would view the target, and thus the X-ray spot, from the side, allowing it to correctly acquire an image from which the extension of the X-ray spot in the travelling direction of the target may be determined. It is however a clear advantage using the electron sensor, which e.g. may be arranged downstream of the target relative the electron beam, for determining the extension of the electron spot in the other, lateral direction.

According to an embodiment wherein the X-ray source is part of a system comprising focusing X-ray optics, the X-ray sensor may be arranged in the focal plane of said optics, i.e. in the plane where the X-ray optics will create an image of the X-ray spot. With knowledge of the magnification of the optics the size of the X-ray spot may be calculated from the measurement performed in the focal plane. In an embodiment comprising focusing X-ray optics where maximum X-ray flux is desired it may be sufficient to measure the X-ray flux and adjust the height of the electron spot so as to increase the measured X-ray flux while keeping the width constant so as to keep the thermal load on the target constant. In this embodiment it may be sufficient to use an X-ray sensitive diode as X-ray sensor. In this case the absolute height of the electron spot may not be obtained.

In some embodiments, it is desirable to provide an X-ray spot having a height that is as small as possible. This may be achieved by adjusting the electron beam such that the electron spot height is decreased, preferably while maintaining the power density below a predetermined limit. To ensure that the X-ray spot height actually decreases, it may be necessary to provide a relative or absolute measurement of the X-ray spot height, preferably by means of the X-ray sensor.

In some applications, it is desirable to maximise the total X-ray flux (i.e., photons per unit time) that is transmitted by means of an optical element (such as a pinhole, slit, or mirror). In this case, the electron beam may be adjusted such that a sensor reading indicative of the total transmitted flux is increased, preferably while maintaining the power density below a predetermined limit.

In some applications, the desire may be to maximise the X-ray flux density (i.e., photons per unit time and unit area) in a certain area. In this case, the electron beam may be adjusted so that a sensor reading indicative of the X-ray flux density in that area is increased, preferably while maintaining the power density below a predetermined limit.

Regardless of whether the X-ray flux or the X-ray flux density is intended to be maximised, a measure indicative of the relevant X-ray flux (e.g. the X-ray flux transmitted by an optical element, or the X-ray flux transmitted through a certain area) may be required. The X-ray flux density may be calculated based on the actual area over which the flux is measured provided the area is known. However, for a given setup of the X-ray source, increasing either the X-ray flux or the X-ray flux density may correspond to increasing the measure indicative of the relevant X-ray flux. The relevant X-ray flux may be increased by increasing the electron flux received by a part of the interaction region where X-ray radiation contributing to the relevant X-ray flux is generated. In neither of these cases is it necessary to determine the extension of the X-ray spot.

In case part of the X-ray radiation generated by the interaction between the electron beam and the target does not contribute to the measured X-ray flux, for example due to geometrical constraints and/or field of view limitations of the components used for measuring the X-ray flux, the height of the electron beam, and thus the height of the X-ray spot, may be reduced in order to allow a larger fraction of the generated X-ray radiation to reach the X-ray sensor. Provided that the power density is already below, and sufficiently close to the predetermined limit, the electron beam width may be kept substantially constant while the height is decreased.

According to an embodiment, an X-ray source as described above may be provided, but without an X-ray sensor. Instead, the X-ray source may comprise an input port configured to receive a signal indicative of an X-ray flux received at an X-ray sensor or detector. The X-ray sensor may be external to the X-ray source, and arranged to receive an X-ray flux generated by the X-ray source. The input port may hence be communicatively connected to the X-ray sensor so as to receive the signal, and operably connected to the controller so that the signal may be used by the controller when adjusting the electron beam to increase the X-ray flux that is generated by the X-ray source and received by the X-ray sensor. Preferably, the controller may adjust the electron beam such that the X-ray flux received by the sensor is increased while the power density is maintained below a predetermined limit. This embodiment may be advantageous for applications in with an X-ray sensor may be needed for other purposes as well.

According to an embodiment, the X-ray source may comprise an X-ray sensor capable of providing data indicating the extension of the X-ray spot in at least two different directions. Thus, not only the height of the X-ray spot, but also its width as seen by the X-ray sensor (also referred to as projected width) may be determined. This may be advantageous in that changes in the projected width may indicate a malperformance of the X-ray source. Causes for changes in the projected width may include changes to the shape of the target or the electron beam. In embodiments comprising a liquid jet target, changes in the projected width may be caused by deviations in the cross sectional shape of the liquid jet, something that may be regarded as a sign of instability. Another possible cause for changes in the projected width may be asymmetries of the electron beam, which in turn may be caused by aging of a cathode used as source for the electron beam.

The electron beam may, at least in some cases, be adjusted to compensate for changes in the projected width of the X-ray spot. In some embodiments, moving the electron beam along the first direction may affect the projected width. Asymmetries in the electron beam power density may require that the total power of the electron beam is decreased to avoid local overheating of the target. Further, in some applications a particular X-ray spot shape may be required. An example of this would be a requirement of a circular spot. In such case, the electron beam may be adjusted so that the X-ray spot height and projected width approach each other, while the power density is maintained below a predetermined limit.

According to an embodiment the measurements of electron spot width and height are repeated over the service life of the X-ray source to ensure consistent performance over time. In case a change in spot size is detected compensations may be applied to an electro-optical system to adjust for these changes.

It is appreciated that other configurations are conceivable as well, and that the above discussed directions, such as the electron-optical axis, the travelling direction and the X-ray propagation direction being orthogonal to each other, are merely examples used for helping to elucidate the inventive concept. Other configurations, relative and orientations and arrangements are however possible within the scope of the appended claims and will be described in further detail in connection with the accompanying drawings.

For the purpose of the present application, a "sensor" or "sensor area" may refer to any sensor suitable for detecting the presence (and, if applicable, power or intensity) of a beam of electrons or X-ray radiation impinging on the sensor; it may also refer to a portion of such sensor. To mention a few examples, sensor may be a charge-sensitive area (e.g. conductive plate earthed via ammeter), a scintillator, a light sensor, a charge-coupled device (CCD), or the like.

It is not necessary that the electron sensor or sensor arrangement is centred on an electron-optical axis defined by the electron-optical means. It may be sufficient for the sensor position to be known relative to the optical axis of the system, and/or the position of the interaction region.

The width of the electron beam may be defined as the full width at half maximum of the electron beam intensity distribution, as seen in a cross section of the electron beam. The width of the electron be may be referred to as "spot size" or "focal spot size" of the electron beam when impinging on the target. The width of the X-ray spot may be defined in a similar manner, i.e., as the FWHM of the spatial intensity distribution.

The term "spot size" may, when considering the electron spot, refer to an extension in one or several directions, or to a cross sectional area of the electron beam. Thus, the terms "first extension" and "second extension" may refer to a first diameter and a second diameter, or a first cross sectional length and second a second cross sectional length, of the spot on the target. These directions are not necessarily orthogonal. In some embodiments, they may however be orthogonal, and may further be referred to as a height and a width, or a vertical extension and a lateral extension, of the spot.

The interaction region may refer to a surface or volume of the target wherein X-ray radiation is generated. In particular, the interaction region may refer to a surface or volume wherein X-ray radiation, which may be transmitted via an X-ray window of the X-ray source, is generated. In one example, the width of the electron beam at the surface of the interaction region is defined as the full width at half maximum of the electron beam intensity distribution. The surface of the interaction region on the target may be referred to as a "spot size" of the electron beam. In general, the interaction region may have a wider cross section than the electron beam spot size because of electron scattering within the target.

In the context of the present application, the term 'particles', 'contaminants' and 'vapour' may refer to free particles, including debris, droplets and atoms, generated during operation of the X-ray source. These terms may be used interchangeably throughout the application. The particles may thus be generated due to a phase transition of the material of the target to vapour. Evaporation and boiling are two examples of such a transition. Further, particles such as e.g. debris may be generated by e.g. overheating of a solid target, and splashing, heavy impacts or turbulence of a liquid target. Thus, it is realised that the particles referred to in the present disclosure are not necessarily limited to particles originating from a vaporisation process.

It will be appreciated that the target may be a solid target of stationary or rotating type, or a liquid target. The term "liquid target" or "liquid anode" may, in the context of the present application, refer to a liquid jet, a stream, or flow of liquid being forces through a nozzle and propagating through an interior of a vacuum chamber of the X-ray source. Even though the jet in general may be formed of an essentially continuous flow or stream of liquid, it will be appreciated that the jet additionally, or alternatively, may comprise or even be formed of a plurality of droplets. In particular, droplets may be generated upon interaction with the electron beam. Such examples of groups or clusters of droplets may be encompassed by the term "liquid jet" or "target". Alternative embodiments of the liquid target may include multiple jets, a pool of liquid either stationary or rotating, liquid flowing over a solid surface, or liquid confined by solid surfaces.

It will be appreciated that the liquid for the target may be a liquid metal, preferably with low melting point, such as e.g. indium, tin, gallium, lead or bismuth, or an alloy thereof. Further examples of liquids include e.g. water and methanol.

According to an embodiment wherein the liquid target is provided as a liquid jet, the X-ray source may further comprise, or be arranged in, a system comprising a closed-loop circulation system. The circulation system may be located between a collection reservoir, arranged for receiving the liquid target material down stream of the interaction region, and a target generator, arranged for generating the liquid jet, and may be adapted to circulate the collected liquid of the liquid jet to the target generator. The closed-loop circulation system allows for continuous operation of the X-ray source, as the liquid may be reused.

The technology disclosed may be embodied as computer readable instructions for controlling a programmable computer in such manner that it causes an X-ray source to perform the method outlined above. Such instructions may be distributed in the form of a computer-program product comprising a non-volatile computer-readable medium storing the instructions.

It will be appreciated that any of the features in the embodiments described above for the method according to the first aspect above may be combined with the X-ray source according to the second aspect of the present invention, and vice versa.

Further objectives of, features of, and advantages with the present invention will become apparent when studying the following detailed disclosure, the drawings and the appended claims. Those skilled in the art will realize that different features of the present invention can be combined to create embodiments other that those described in the following.

BRIEF DESCRIPTION OF THE DRAWINGS

The invention will now be described for the purpose of exemplification with reference to the accompanying drawings, on which.

All figures are schematic, not necessarily to scale, and generally only show parts that are necessary in order to elucidate the invention, wherein other parts may be omitted or merely suggested.

DETAILED DESCRIPTION OF EMBODIMENTS

Figure 1A:
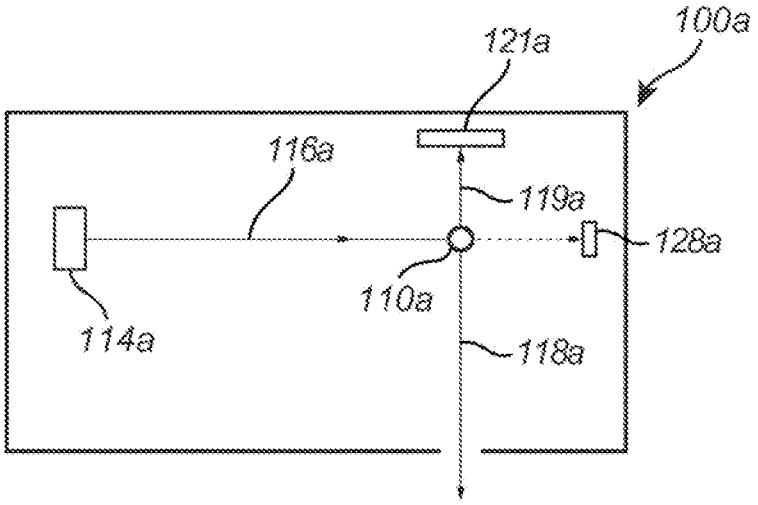
FIG. 1*a* is a schematic, cross sectional side view of an X-ray source according to some embodiments of the present invention.

Referring first to FIG. 1*a*, a cross sectional side view of an X-ray source 100*a* according to some embodiments of the present invention is illustrated. The X-ray source 100*a* comprises a target 110*a* here illustrated in the cross-sectional view by a circle. However, it is envisioned that the target 110*a* may assume other shapes or forms, and in particular it should be noted that the target 110*a* may be a liquid target, a rotating target, a solid target, or any other type of target capable of generating X-ray radiation by interaction with an electron beam.

The X-ray source 100*a* further comprises an electron source 114*a* operable to generate an electron beam 116*a* travelling along an electron-optical axis and interacting with the target 110*a* to generate X-ray radiation. In the illustrated example, a first quantity of generated X-ray radiation 118*a* exits the X-ray source 100*a* in an exit direction along an axis that is substantially perpendicular to the electron-optical axis. A second quantity of generated X-ray radiation 119*a* travels in a direction being opposite the exit direction, towards an X-ray sensor 121*a*, i.e. a second sensor. The X-ray source 100*a* also comprises an electron detector 128*a*, i.e. a first sensor, configured to detect electrons indicative of the interaction between the electron beam and the target. In particular, the electron detector 128*a* is configured to receive at least part of the electron beam 116*a* passing the target 110*a*. The electron detector 128*a* is here arranged downstream of the target 110*a* with respect to the electron-optical axis. As is readily understood from the present disclosure, the first sensor, e.g. the electron detector 128*a*, may be arranged at other locations, and may be configured to detect e.g. backscattered electrons, secondary electrons, electrons passing the target 110*a*, electrons absorbed in the target 110*a*, and the like.

Figure 1B:
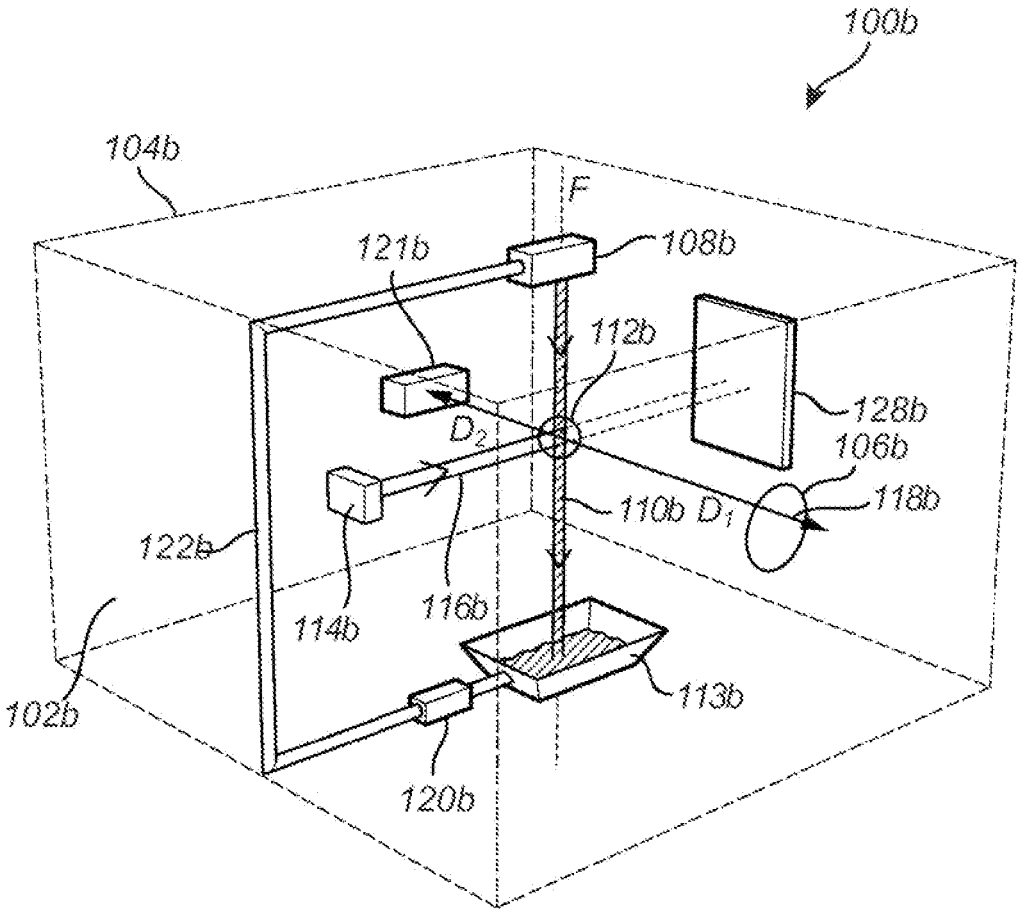
FIG. 1*b* is a schematic, perspective view of an X-ray source according to an embodiment comprising a liquid metal jet target.

Referring now to FIG. 1*b*, a cross sectional side view of an X-ray source according to an embodiment comprising a liquid metal jet target is illustrated. The illustrated X-ray source 100*b* utilizes a liquid jet 110*b* as a target for the electron beam. However, as is readily appreciated by the person skilled in the art, other types of targets, such as moving targets, or rotating solid targets, are equally possible within the scope of the inventive concept. Further, some of the disclosed features of the X-ray source 100*b* are merely included as possible examples, and may not be necessary for the operation of the X-ray source 100*b*.

As indicated in FIG. 1*b*, a low pressure chamber, or vacuum chamber, 102*b* may be defined by an enclosure 104*b* and an X-ray transparent window 106*b* which separates the low pressure chamber 102*b* from the ambient atmosphere. The X-ray source 100*b* comprises a liquid jet generator 108*b* configured to form a liquid jet 110*b* moving along a flow axis F. The liquid jet generator 110*b* may comprise a nozzle through which liquid, such as e.g. liquid metal may be ejected to form the liquid jet 110*b* propagating towards and through an intersecting region 112*b*. The liquid jet 110*b* propagates through the intersecting region 112*b* towards a collecting arrangement 113*b* arranged below the liquid jet generator 108*b* with respect to the flow direction. The X ray source 100 further comprises an electron source 114*b* configured to provide an electron beam 116*b* directed towards the intersecting region 112*b* along an electron-optical axis. The electron source 114*b* may comprise a cathode for the generation of the electron beam 116*b*. In the intersecting region 112*b*, the electron beam 116*b* interacts with the liquid jet 110*b* to generate X-ray radiation 118*b*, which is transmitted out of the X-ray source 100*b* via the X-ray transparent window 106*b*. A first quantity of X-ray radiation 118*b* is here directed out of the X ray source 100*b* in an exit direction $D_1$ substantially perpendicular to the direction of the electron beam 116*b*, i.e. the electron-optical axis, and the flow axis F.

The liquid forming the liquid jet is collected by the collecting arrangement 113*b*, and is subsequently recirculated by a pump 120*b* via a recirculating path 122*b* to the liquid jet generator 108*b*, where the liquid may be reused to continuously generate the liquid jet 110*b*.

Still referring to FIG. 1*b*, the X-ray source 100*b* here comprises an electron detector 128*b*, i.e. a first sensor, configured to receive at least part of the electron beam 116*b* passing the liquid jet 110*b*. The electron detector 128*b* is here arranged behind the intersecting region 112*b* as seen from a viewpoint of the electron source 114*b*. It is to be understood that the shape of the electron detector 128*b* is here merely schematically illustrated, and that other shapes of the electron detector 128*b* may be possible within the scope of the inventive concept. The X-ray source 100*b* also comprises an X-ray sensor 121*b*, i.e. a second sensor, configured to detect X-ray radiation generated by the interaction between the electron beam and the target. The X-ray sensor 121*b* is here arranged on an opposite side of the target 110*b* with respect to the X-ray window 106*b*. In particular, the X-ray sensor 121*b* may be arranged such that a second quantity of X-ray radiation 119*b* generated by the interaction between the electron beam 116*b* and the target 100*b*, in a direction $D_2$ being substantially perpendicular to the flow axis F and the electron-optical axis, may reach the X-ray sensor 121*b*.

Figure 2:
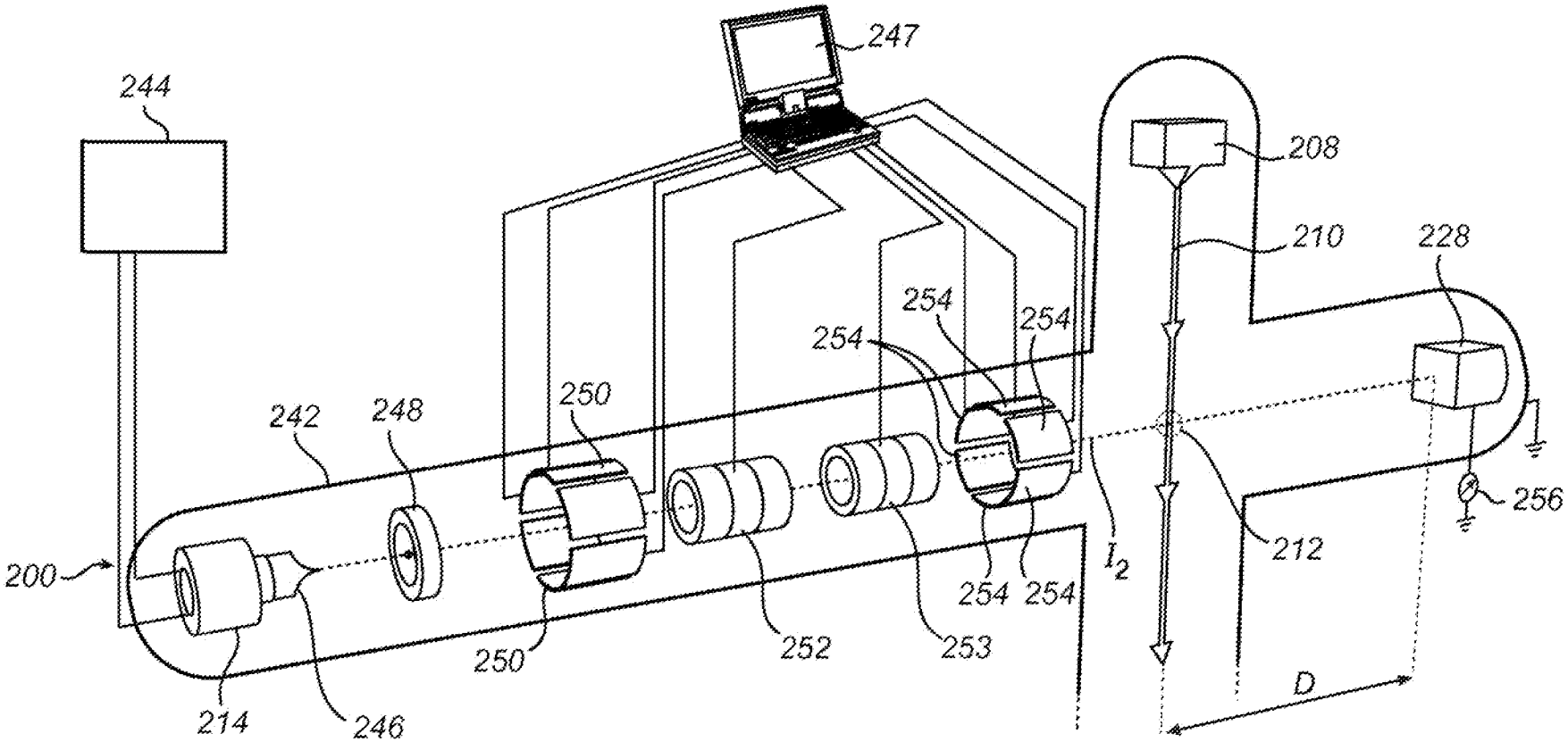
FIG. 2 is a schematic perspective view of an X-ray source according to an embodiment comprising a liquid metal jet target.

Referring now to FIG. 2, a schematic perspective view of an X-ray source 200 according to an embodiment comprising a liquid metal jet target is illustrated. The illustrated X-ray source 200 utilizes a liquid jet 200 as a target for the electron beam. However, as is readily appreciated by the person skilled in the art, other types of targets, such as moving targets, or rotating solid targets, are equally possible within the scope of the inventive concept. Further, some of the disclosed features of the X-ray source 200 are merely included as possible examples, and may not be necessary for the operation of the X-ray source 200.

The X-ray source 200 generally comprises an electron source 214, 246, and a liquid jet generator 208 configured to form a liquid jet 210 acting as an electron target. The components of the X-ray source 200 is located in a gas-tight housing 242, with possible exceptions for a power supply 244 and a controller 247, which may be located outside the housing 242 as shown in the drawing. Various electron-optical components functioning by electromagnetic interaction may also be located outside the housing 242 if the latter does not screen off electromagnetic fields to any significant extent. Accordingly, such electron-optical components may be located outside the vacuum region if the housing 242 is made of a material with low magnetic permeability, e.g., austenitic stainless steel.

The electron source generally comprises a cathode 214 which is powered by the power supply 244 an includes an electron emitter 246, e.g. a thermionic, thermal-field or cold-field charged-particle source. Typically, the electron energy may range from about 5 keV to about 500 keV. An electron beam from the electron source is accelerated towards an accelerating aperture 248, at which point it enters an electron-optical system comprising an arrangement of aligning plates 250, lenses 252 and an arrangement of deflection plates 254. Variable properties of the aligning plates 250, lenses 252, and deflection plates 254 are controllable by signals provided by the controller 247. In the illustrated example, the deflection and alignment plates 250, 254 are operable to accelerate the electron beam in at least two transversal directions. After initial calibration, the aligning plates 250 are typically maintained at a constant setting throughout a work cycle of the X-ray source 200, while the deflection plates 254 are used for dynamically scanning or adjusting an electron spot location during use of the X-ray source 200. Controllable properties of the lenses 252 include their respective focusing powers (focal lengths). Although the drawing symbolically depicts the aligning, focusing and deflecting means in a way to suggest that they are of the electrostatic type, the invention may equally well be embodied by using electromagnetic equipment or a mixture of electrostatic and electromagnetic electron-optical components. The X-ray source may comprise stigmator coils 253 which may provide for that a non-circular shape of the electron spot is achieved.

Downstream of the electron-optical system, an outgoing electron beam $I_2$ intersects with the liquid jet 210 in an intersecting region 212. This is where the X-ray production may take place. X-ray radiation may be led out from the housing 242 in a direction not coinciding with the electron beam. Any portion of the electron beam $I_2$ that continues past the intersecting region 212 may reach an electron detector 228. In the illustrated example, the electron detector 228 is simply a conductive plate connected to earth via an ammeter 256, which provides an approximate measure of the total current carried by the electron beam $I_2$ downstream of the intersecting region 212. As the figure shows, the electron detector 228 is located a distance D away from the intersecting region 212, and so does not interfere with the regular operation of the X-ray source 200. Between the electron detector 228 and the housing 242, there is electrical insulation, such that a difference in electrical potential between the electron detector 228 and the housing 242 can be allowed. Although the electron detector 228 is shown to project out from the inner wall of the housing 242, it should be understood that the electron detector 228 could also be mounted flush with the housing wall. The electron detector may further be equipped with an aperture arranged so that electron impinging inside the aperture may be registered by the electron detector whereas electrons impinging outside of the aperture may not be detected.

A lower portion of the housing 242, a vacuum pump or similar means for evacuating gas molecules from the housing 242, receptacles and pumps for collecting and recirculating the liquid jet are not shown on this drawing. It is also understood that the controller 247 has access to the actual signal from the ammeter 256.

The X-ray source 200 may further comprise an X-ray transparent window (not shown) and an X-ray detector (not shown) similar to components 106*b* and 121*b* in FIG. 1*b*. The electron-optical system described may be used to adjust the electron beam extension based on measurement from the electron detector 228 and/or the X-ray detector (not shown). By adjusting both the focusing lens 252 and the stigmator coils 253 the electron width of the electron focal spot may be adjusted independently in directions along and perpendicularly to the flow direction of liquid jet 210.

Figure 3A:
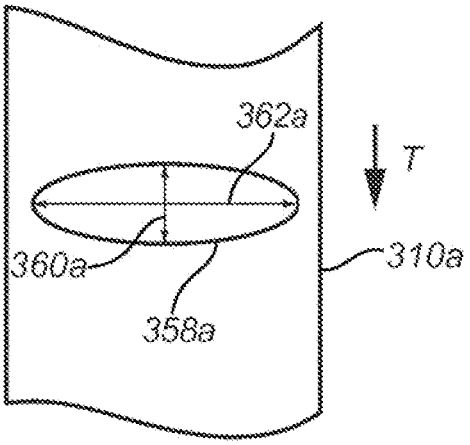
FIGS. 3*a* and 3*b* illustrate different examples of an electron focal spot on a target according to embodiments of the present invention.
Figure 3B:
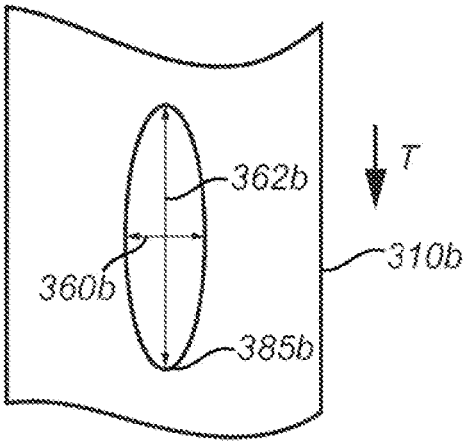

Referring now to FIGS. 3*a* and 3*b*, different examples of an electron focal spot on a target according to embodiments of the present invention are illustrated.

In FIG. 3*a*, a non-circular electron focal spot 358*a* is shown on a target 310*a*. The electron focal spot 358*a* is here oriented such that its longest extension, here a width 360*a*, is arranged along a direction being perpendicular to a direction of travel T of the target 310*a*. The narrowest or shortest extension of the electron focal spot 358*a*, here the length 362*a*, is arranged along the direction of travel T. Such an arrangement may allow for a relatively high total power of the electron beam to be used without overheating the target 310*a*. The width 360*a* may be at least twice as long as the length 362*a*, such as at least four time as long. In an embodiment the width 360*a* may be between 40 μm and 80 μm correspondingly the length 362*a* may be between 10 μm and 20 μm. Different combinations within these intervals may be used to an advantage.

In FIG. 3*b*, a non-circular electron focal spot 358*b* is shown on a target 310*b*. The electron focal spot 358*b* is here oriented such that its shortest extension, here a width 360*b*, is arranged along a direction being perpendicular to a direction of travel T of the target 310*b*. The most broad or longest extension of the electron focal spot 358*b*, here the length 362*b*, is arranged along the direction of travel T. Such an arrangement may apply an unnecessary load on the target 310*b*, which increases the risk of overheating the target 310*b* at a given total power of the electron beam compared to the arrangement disclosed in conjunction with FIG. 3*a*.

Figure 4:
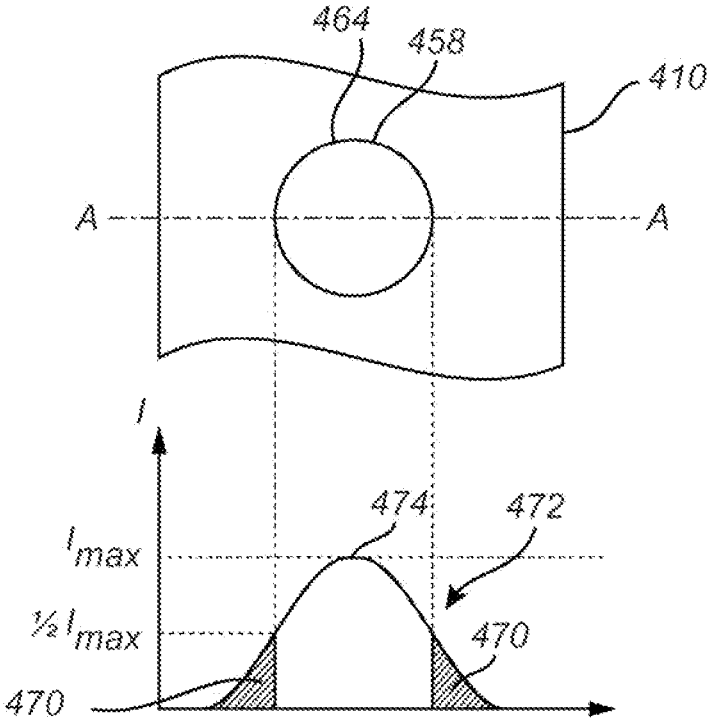
FIG. 4 illustrate the relationship between an electron beam and X-ray radiation generated by the interaction between the electron beam and a target.

Referring now to FIG. 4, an example of the relationship between an electron focal spot size 458 and X-ray radiation generated by the interaction between the electron beam and a target, i.e. the interaction region 464, is illustrated. It should be noted that this figure is not necessarily drawn to scale, and that the shapes of the illustrated features are not limiting but merely an example of possible shapes. It should further be noted that the illustrated example is merely one way of defining the electron focal spot size and the interaction region wherein X-ray radiation is generated, and that other definitions may be made without departing from the scope of the present inventive concept.

Part of a target 410 is shown, whereon an electron focal spot size 458 and an interaction region 468 are illustrated. It may be noted that the interaction region 468 and the electron focal spot size 458 are overlapping. The graph below the target 410 illustrate properties of an intensity distribution of the electron beam along the line A-A indicated on the target 410.

As defined in the present disclosure, the interaction region 468 corresponds to the full width at half maximum Imax of the intensity distribution. Also, as illustrated by the shaded area 470, some electrons do not contribute to the generation of X-ray radiation and may in some respects be deemed wasted. The area 470 under the graph 472 reflect the power of electrons that do not contribute to the generation of X-ray radiation. Similarly, the area 474 under the graph 472 reflect the power of electrons that contribute to the generation of X-ray radiation.

Figure 5:
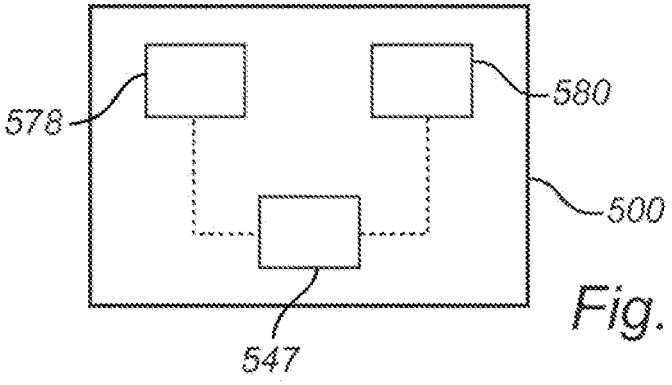
FIG. 5 is a schematic representation of a system according to an embodiment.

Referring now to FIG. 5, a schematic representation of an X-ray source 500 according to an embodiment is illustrated. The X-ray source 500 comprises a first sensor 578 adapted to detect electrons indicative of the interaction between the electron beam and the target, a second sensor 580 adapted to detect X-ray radiation generated by the interaction between the electron beam and the target, and a controller 547 operably connected to the first sensor, the second sensor and electron-optical means (not illustrated).

Figure 6:
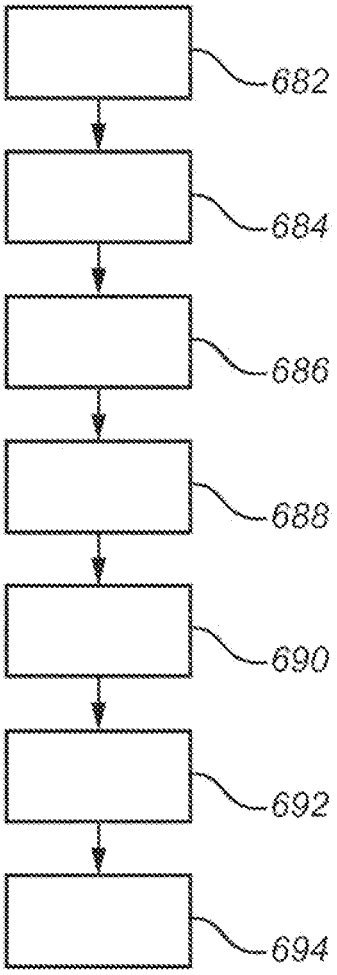
FIG. 6 schematically illustrates a method according an embodiment.

A method in an X-ray source according to the inventive concept will now be described with reference to FIG. 6. For clarity and simplicity, the method will be described in terms of 'steps'. It is emphasized that steps are not necessarily processes that are delimited in time or separate from each other, and more than one 'step' may be performed at the same time in a parallel fashion.

The method in the X-ray source configured to emit, from an interaction region, X-ray radiation generated by an interaction between an electron beam and a target, comprises the step 682 of providing the target, the step 684 of providing the electron beam, the step 686 of deflecting the electron beam along a first direction relative the target, the step 688 of detecting electrons indicative of the interaction between the electron beam and the target, the step 690 of determining a first extension of the electron beam on the target, along the first direction, based on the detected electrons and the deflection of the electron beam, the step 692 of detecting X-ray radiation generated by the interaction between the electron beam and the target, and the step 694 of determining a second extension of the electron beam on the target, along a second direction, based on the detected X-ray radiation.

The person skilled in the art by no means is limited to the example embodiments described above. On the contrary, many modifications and variations are possible within the scope of the appended claims. In particular, X-ray sources and systems comprising more than one target or more than one electron beam are conceivable within the scope of the present inventive concept. Furthermore, X-ray sources of the type described herein may advantageously be combined with X-ray optics and/or detectors tailored to specific applications exemplified by but not limited to medical diagnosis, non-destructive testing, lithography, crystal analysis, microscopy, materials science, microscopy surface physics, protein structure determination by X-ray diffraction, X-ray photo spectroscopy (XPS), critical dimension small angle X-ray scattering (CD-SAXS), and X-ray fluorescence (XRF). Additionally, variation to the disclosed examples can be understood and effected by the skilled person in practicing the claimed invention, from a study of the drawings, the disclosure, and the appended claims. The mere fact that certain measures are recited in mutually different dependent claims does not indicate that a combination of these measures cannot be used to advantage.

The invention claimed is:

1. A method in an X-ray source configured to emit, from an interaction region, X-ray radiation generated by an interaction between an electron beam and a target, the method comprising the steps of:

providing the target;

providing the electron beam;

deflecting the electron beam along a first direction relative to the target;

detecting electrons indicative of the interaction between the electron beam and the target;

determining a first extension of the electron beam on the target, along the first direction, based on the detected electrons and the deflection of the electron beam;

detecting X-ray radiation generated by the interaction between the electron beam and the target; and determining a second extension of the electron beam on the target, along a second direction, based on the detected X-ray radiation.

2. The method according to claim 1, wherein the target partially obscures a sensor area, the method further comprising:

deflecting at least a part of the electron beam between the target and an unobscured portion of the sensor area.

3. The method according to claim 1, wherein the electron beam forms a spot on the target, the spot being wider in the first direction than in the second direction.

4. The method according to claim 1, wherein the first direction is substantially perpendicular to the second direction, and wherein the target is moving along the second direction.

5. The method according to claim 1, further comprising:

adjusting, based on at least one of the determined first extension and the determined second extension of the electron beam, an intensity of the electron beam such that a power density supplied to the target is maintained below a predetermined limit.

6. The method according to claim 1, further comprising adjusting the electron beam such that the second extension of the electron beam on the target is decreased while the first extension of the electron beam on the target is maintained.

7. An X-ray source configured to emit X-ray radiation, comprising:

a target;

an electron source operable to generate an electron beam interacting with the target in an interaction region to generate X-ray radiation;

electron-optics for controlling the electron beam;

a first sensor adapted to detect electrons indicative of the interaction between the electron beam and the target;

a second sensor adapted to detect X-ray radiation generated by the interaction between the electron beam and the target; and a controller operably connected to the first sensor, the second sensor and the electron-optics;

wherein:

the electron-optics is configured to deflect the electron beam in a first direction relative to the target;

the controller is adapted to:

determine a first extension of the electron beam on the target, along the first direction, based on the detected electrons and the deflection of the electron beam; and determine a second extension of the electron beam on the target, along a second direction, based on the detected X-ray radiation.

8. The X-ray source according to claim 7, wherein the target is a moving target configured to move along the second direction.

9. The X-ray source according to claim 8, wherein the second sensor is arranged to detect X-ray radiation propagating in a direction substantially perpendicular to the electron beam and the moving direction of the target.

10. The X-ray source according to claim 7, wherein the target is a liquid target propagating along the second direction.

11. The X-ray source according to claim 7, wherein said electron-optics is arranged to provide an elongated cross section of the electron beam on the target, wherein the largest diameter of the cross section is substantially parallel to the first direction.

* * * * *